US009270058B2

(12) United States Patent
Wu et al.

(10) Patent No.: US 9,270,058 B2
(45) Date of Patent: Feb. 23, 2016

(54) CABLE CONNECTOR ASSEMBLY HAVING A SHIELD SHELL WITH A METAL SHRAPNEL

(71) Applicant: HON HAI PRECISION INDUSTRY CO., LTD., New Taipei (TW)

(72) Inventors: Jerry Wu, Irvine, CA (US); Jun Chen, Kunshan (CN); Fan-Bo Meng, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/489,434

(22) Filed: Sep. 17, 2014

(65) Prior Publication Data

US 2015/0079834 A1 Mar. 19, 2015

(30) Foreign Application Priority Data

Sep. 17, 2013 (CN) ..... 2013 2 0574646 U

(51) Int. Cl.

| | |
|---|---|
| ***H01R 13/659*** | (2011.01) |
| ***H01R 13/6591*** | (2011.01) |
| *H01R 13/518* | (2006.01) |
| *H01R 13/6596* | (2011.01) |
| *H01R 13/74* | (2006.01) |

(52) U.S. Cl.

CPC ..... *H01R 13/6591* (2013.01); *H01R 13/659* (2013.01); *H01R 13/518* (2013.01); *H01R 13/6596* (2013.01); *H01R 13/74* (2013.01)

(58) Field of Classification Search

CPC ..... H01R 13/6582; H01R 13/6583; H01R 13/6591

See application file for complete search history.

(56) References Cited

U.S. PATENT DOCUMENTS

| | | | | |
|---|---|---|---|---|
| 5,600,544 | A * | 2/1997 | Thalhammer | H01R 23/6873 174/351 |
| 6,722,924 | B1 | 4/2004 | Zhou et al. | |
| 6,846,200 | B1 * | 1/2005 | Hsu | H01R 13/65802 439/540.1 |
| 8,157,584 | B2 * | 4/2012 | Zhou | H01R 13/518 439/540.1 |
| 2009/0269977 | A1 * | 10/2009 | Chen | H01R 13/518 439/540.1 |
| 2010/0112863 | A1 * | 5/2010 | Xiao | H01R 27/02 439/607.27 |
| 2012/0129397 | A1 * | 5/2012 | Chen | H01R 13/514 439/607.24 |
| 2012/0156924 | A1 * | 6/2012 | Chen | H01R 13/518 439/488 |
| 2013/0149900 | A1 * | 6/2013 | Zhang | H01R 13/659 439/607.01 |
| 2014/0017939 | A1 * | 1/2014 | Xie | H01R 13/6583 439/607.01 |
| 2014/0154929 | A1 * | 6/2014 | Yin | H01R 13/6275 439/660 |
| 2015/0079834 | A1 * | 3/2015 | Wu | H01R 13/659 439/357 |

FOREIGN PATENT DOCUMENTS

| | | |
|---|---|---|
| TW | M346200 | 12/2008 |
| TW | I394318 | 4/2013 |

* cited by examiner

*Primary Examiner* — James Harvey

(74) *Attorney, Agent, or Firm* — Wei Te Chung; Ming Chieh Chang

(57) ABSTRACT

A cable connector assembly for being mounted on an external device for docking a mating connector, the cable connector assembly including a shield shell having a plurality of metal shrapnel, an insulative housing received in the shield shell, a plurality of connectors received in the insulative housing, and a cable connecting with the connector. The connector has a metal shell. The metal shrapnel is movable by the external device to be elastically pressed between the connector metal shell and the external device.

20 Claims, 6 Drawing Sheets

CABLE CONNECTOR ASSEMBLY HAVING A SHIELD SHELL WITH A METAL SHRAPNEL

BACKGROUND OF THE INVENTION

1. Field of the Invention

The present invention relates to a cable connector assembly and especially relates to a shield shell having a number of metal shrapnel.

2. Description of Related Art

Taiwan Utility Model No. 346200 discloses a cable connector assembly for being mounted to a panel of a computer casing. The cable connector assembly includes a number of connectors, an insulative housing receiving the connectors, and a shield shell enclosing the insulative housing. The connector includes a metal shell. The shield shell has a top wall and a front wall perpendicular to the top wall. The top wall has a number of metal shrapnel connectable with the computer casing panel. The front wall has a number of tabs connectable with the connector metal shell. The metal shrapnel elastically contacts the panel to realize grounding of the connector, but does not contact the metal shell. Another tab is needed for the shield shell to contact the metal shell.

U.S. Pat. No. 6,722,924 discloses a cable connector assembly including a dielectric housing, a pair of first connectors, a pair of second connectors, and a shield member. The shield member includes a front wall and a pair of sidewalls. The dielectric housing has an elongate base having a pair of positioning slits. Each sidewall is stamped to form a plurality of engaging tabs protruding outwardly and a pair of contacting tabs protruding inwardly. The engaging tabs are devised for electrically engaging with a panel of a computer when the cable connector assembly is assembled in the computer. The second connector further includes a grounding terminal The contacting tabs extend through the positioning slits of the housing and electrically contact the grounding terminals.

In the above prior art designs, extra stamping process is required for producing two sets of grounding pieces and a distance of circuit back becomes longer. Such design does not ensure a low grounding resistance of the cable connector assembly but increases EMI of the cable connector assembly.

An improved cable connector assembly is desired.

SUMMARY OF THE INVENTION

Accordingly, an object of the present invention is to provide a cable connector assembly requiring only a simple stamping manufacturing process while achieving a good effect for preventing EMI.

In order to achieve the object set forth, the invention provides a cable connector assembly for being mounted on an external device for docking a mating connector, comprising: a shield shell having a plurality of metal shrapnel; an insulative housing received in the shield shell; a plurality of connectors received in the insulative housing, the connector having a metal shell; and a cable connecting with the connector; wherein the metal shrapnel is movable by an external device to be elastically pressed between the connector metal shell and the external device.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
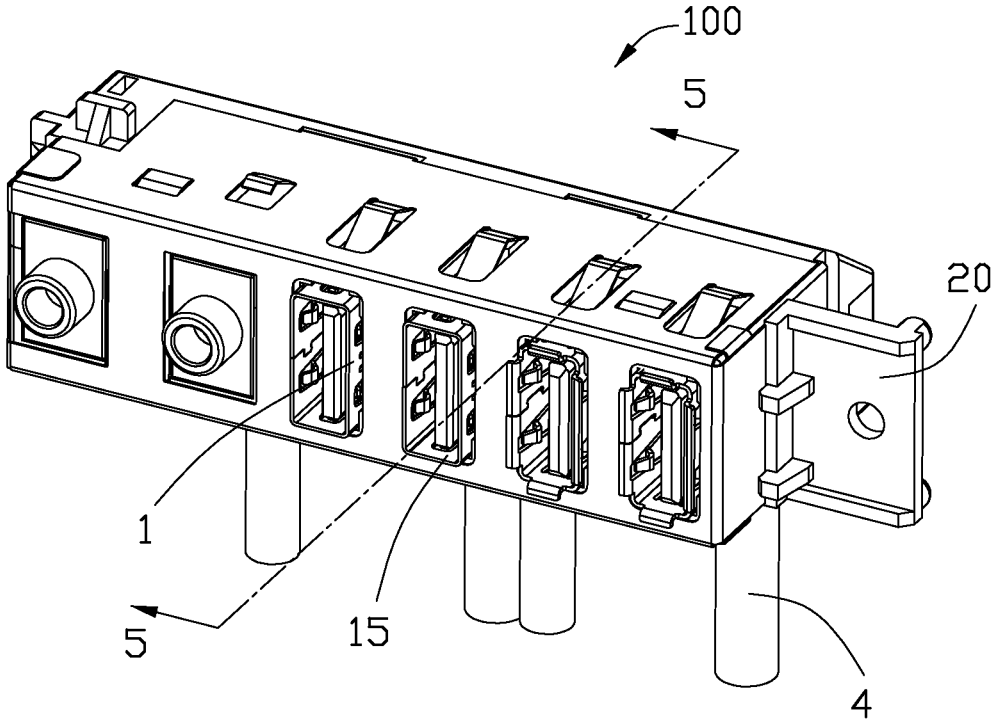
FIG. 1 is a perspective view of a cable connector assembly according to the present invention.
Figure 2:
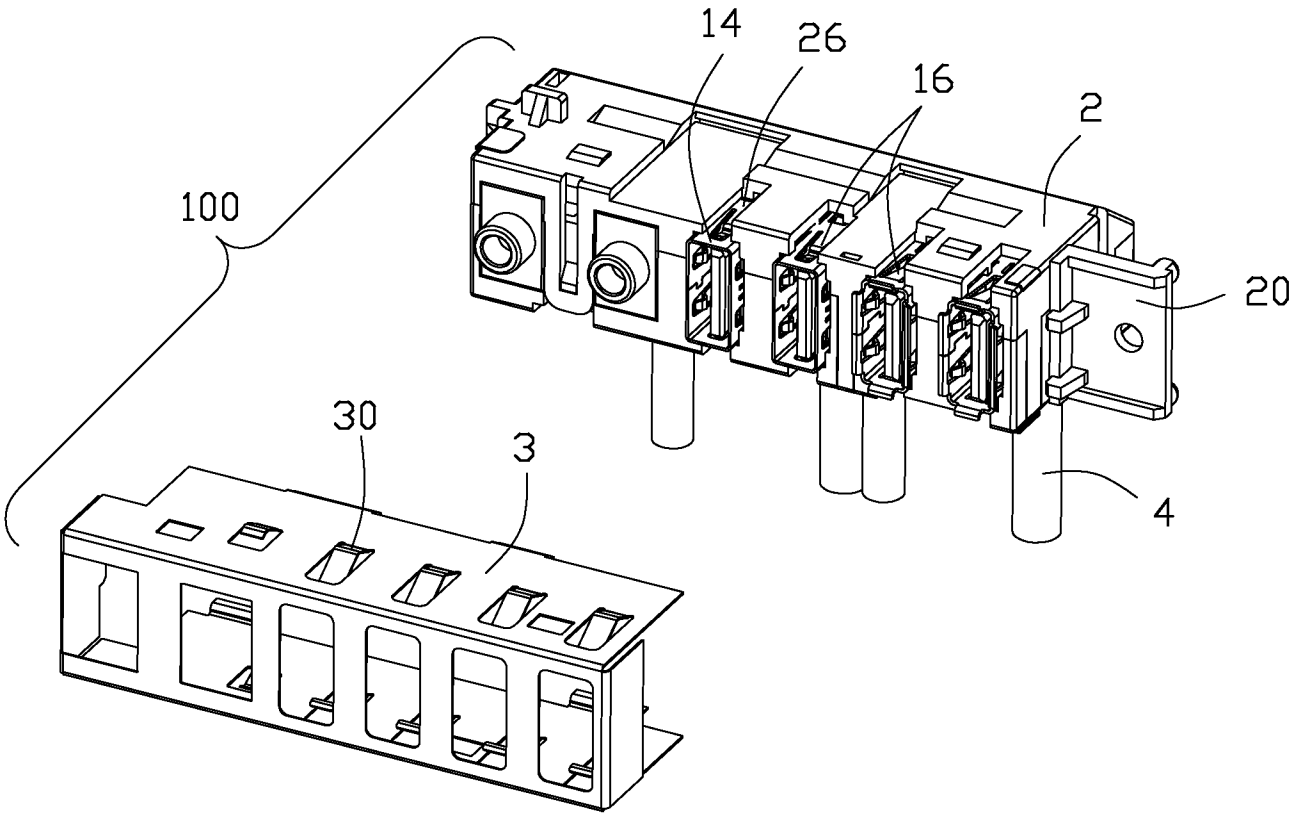
FIG. 2 is an exploded view of a part of the cable connector assembly as shown in FIG. 1.

Referring to FIG. 1 to FIG. 2, a cable connector assembly 100 to be mounted on an external device is shown. The cable connector assembly 100 includes a number of connectors 1, an insulative housing 2 receiving the connectors 1, a shield shell 3 enclosing the insulative housing 2, and a cable 4 connect with the connector 1.

Figure 3:
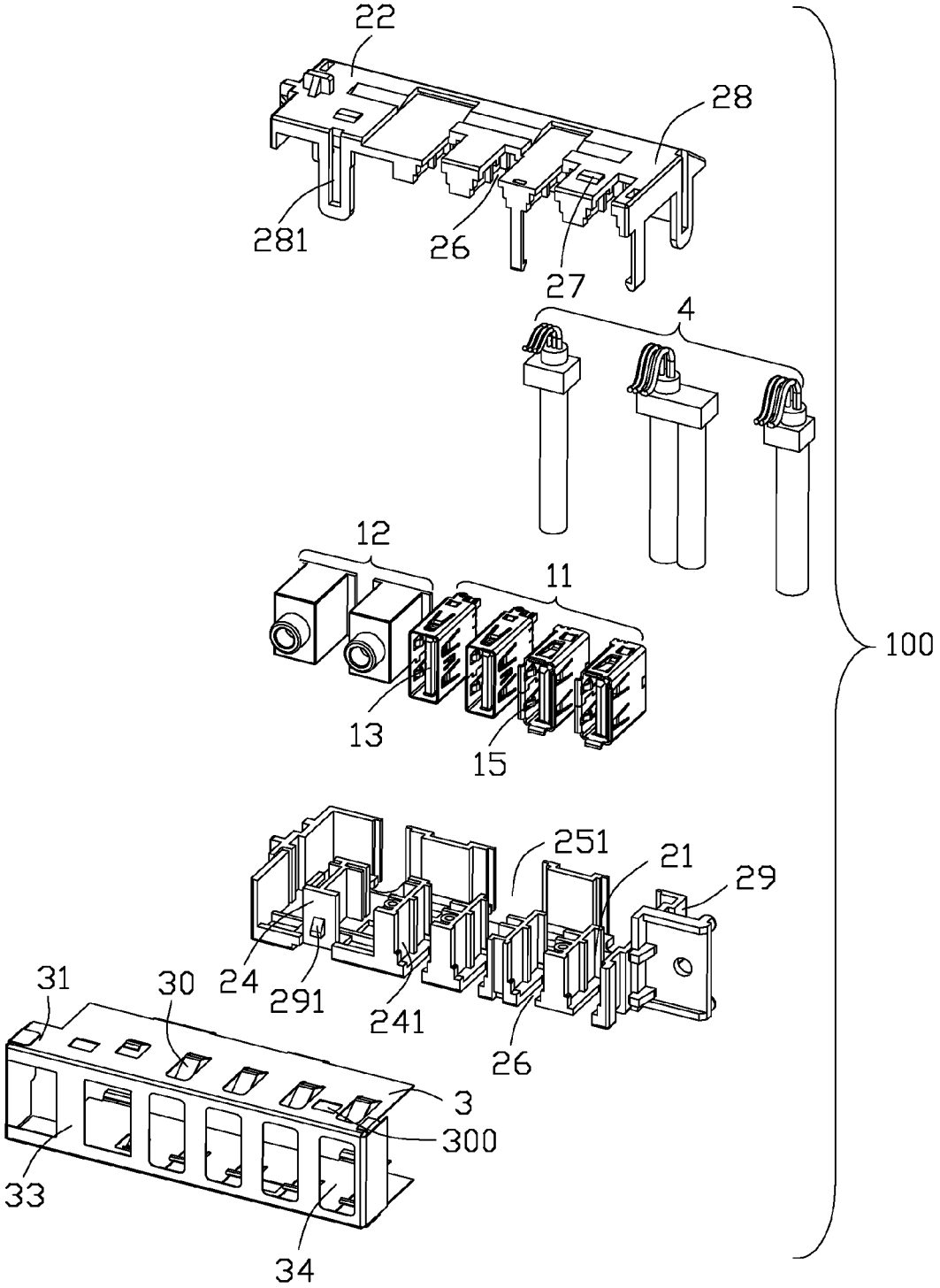
FIG. 3 is an exploded view of the whole cable connector assembly as shown in FIG. 2.
Figure 4:
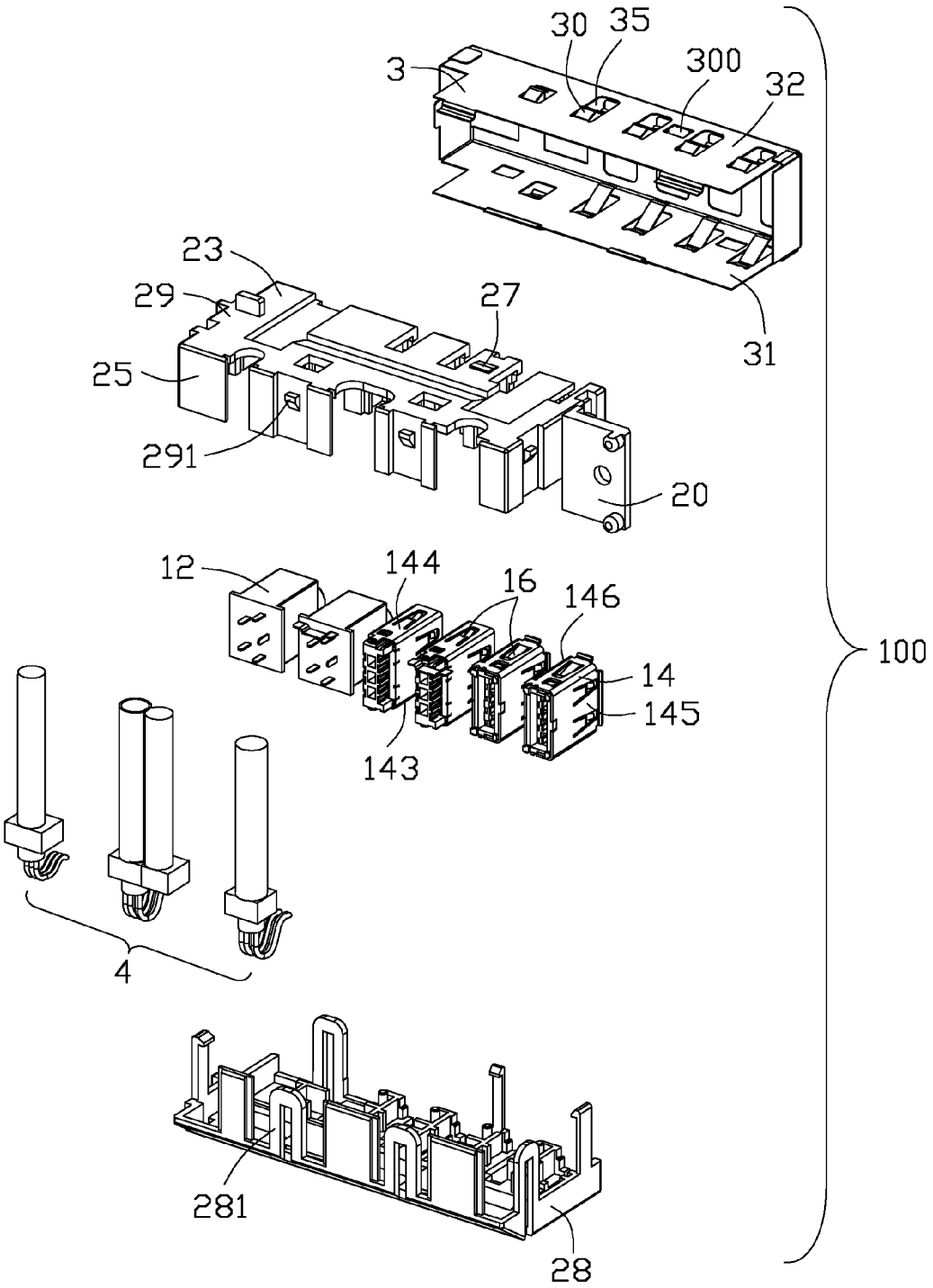
FIG. 4 is another exploded view of the whole cable connector assembly as shown in FIG. 3.
Figure 5:
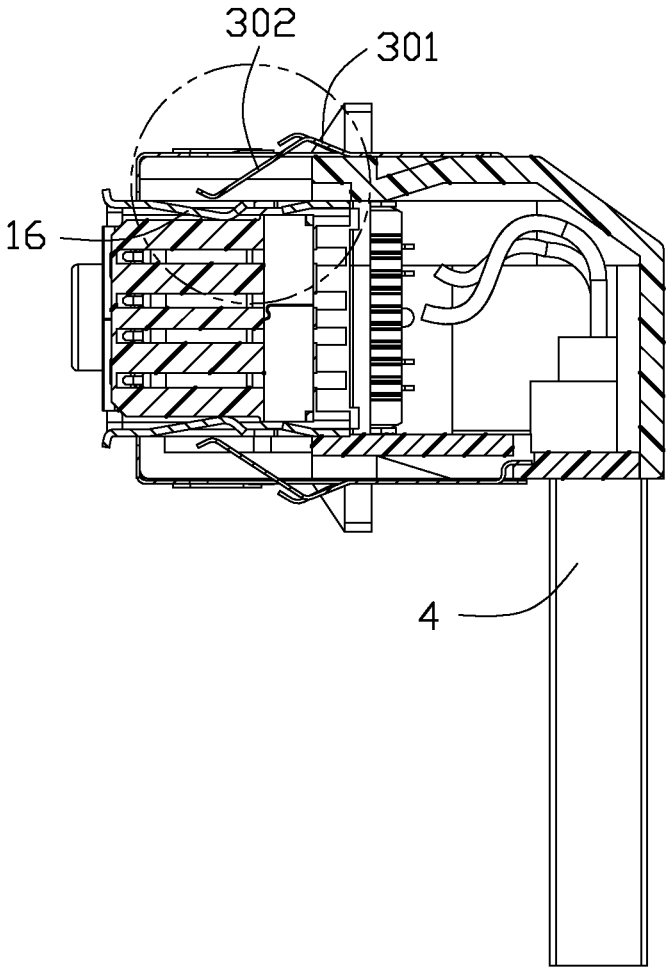
FIG. 5 is a cross-sectional view of the cable connector assembly taken along line 5-5 of FIG. 1.
Figure 6:
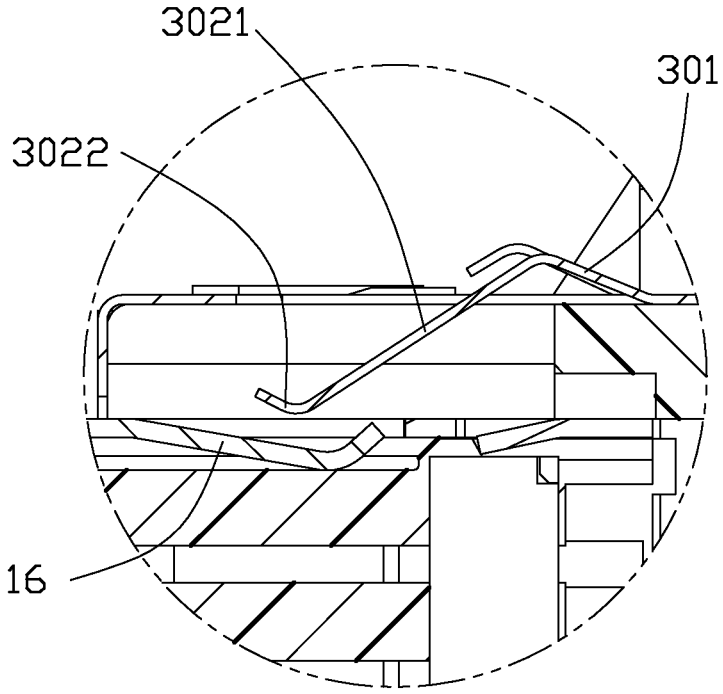
FIG. 6 is a partial enlarged drawing of a circle section as shown in FIG. 5.

Referring to FIG. 3 to FIG. 4, the connector 1 includes a number of first connectors 11 and a number of second connectors 12. The first connectors 11 are USB connectors arranged in a row in a transverse direction. The second connectors 12 are audio jack connectors arranged in a row in the transverse direction. In this embodiment, the first connectors 11 are located in one side of the second connectors 12. The first connector 11 includes a terminal plate 13, a metal shell 14 enclosing the terminal plate 13, and a mating port 15 defined in the metal shell 14. The cable 4 electrically connects with the terminal plate 13 and then bend to extend beyond the insulative housing 2.

The insulative housing 2 defines a number of receiving cavities 21 separating from each other and a mounting portion 20 mounting the cable connector assembly 100 on the external device. The receiving cavities 21 receive the first connector 11 and the second connector 12. The insulative housing 2 includes an upper board 22, a lower board 23 opposite to the upper board 22, and a front wall 24, and a rear wall 25. Both of the front wall 24 and the rear wall 25 connect with the upper board 22 and the lower board 23. The front wall 24 of the insulative housing 2 defines a number of opening 241 opposite to the receiving cavities 21. Both of the upper board 22 and the lower board 22 define a number of tubers 27. The rear wall 25 of the insulative housing 2 has a number of outlets 251 connecting with the receiving cavities 21. The cable 4 extends through the outlet 251 beyond the insulative housing 2. Both of the upper board 22 and the lower board 23 define a plurality of slots 26 breakthrough along an up-to-down direction for exposing a part of the metal shell 14. The slot 26 connects with the receiving cavities 21. The insulative housing 2 further comprises a top shell 28 and a bottom shell 29, the bottom shell 29 having a plurality of embossments 291, the top shell 28 having a plurality of locking plates 281. The embossment 291 is locked in the locking plate 281 for retaining the top shell 28 and the bottom shell 29 together. The shield shell 3 is formed by punching a flat plate-like metal plate with a bending process. The shield shell 3 includes a number of metal shrapnel 30 and holes 300 locking catch with corresponding tubers 27.

Referring to FIG. 3 to FIG. 6, when the cable connector assembly 100 is not mounted on the external device, the metal shrapnel 30 disconnects the metal shell 14 of the connector 1. When the cable connector assembly 100 is mounted on the external device, the metal shrapnel 30 is pressed by the external device and elastically connects with the metal shell 14 of the connector 1. The shield shell 3 includes a top wall 31, a bottom wall 32 and a front wall 33 enclosing a front end of the insulative housing 2. The front wall 33 has a number of openings 34 opposite to the receiving cavities 21. The connector 1 is received in the opening 34. Both of the top wall 31 and the bottom wall 32 have a number of perforations 35.

The metal shrapnel or spring arm 30 includes a first spring arm 301 extending upward from an edge of the perforation 35 and a second spring arm 302 extending downward to the metal shell 14. The second spring arm 302 includes an extending portion 3021 and a bending portion 3022 extending from an end of the extending portion 3021. When the cable connector assembly 100 is mounted on the external device, the first spring arm 301 is pressed by the external device to drive the bending portion 3022 to elastically contact the metal shell 14 of the connector 1. The metal shrapnel 30 connects the external device and metal shell 14 at the same time in this design. Therefore, the shield shell 3 does not need to add extra metal shrapnel 30 to its stamping manufacturing process. This design shortens the distance of a current circuit of the connector 1 and ensures that the connector 1 has a smaller grounding resistance to reduce EMI of the cable connector assembly 100.

The metal shell 14 includes a top plate 143, a bottom plate 144, a left side wall 145, and a right side wall 146. Both of the top plate 143 and the bottom plate 144 define a tab 16 protruding to inside of the metal shell 14. The second spring arm 302 elastically contacts the tab 16.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A cable connector assembly for being mounted to an external device, comprising:

a shield shell having a plurality of metal shrapnel;

an insulative housing received in the shield shell;

a plurality of connectors received in the insulative housing, at least one of the plurality of connectors having a metal shell; and a cable connecting with the at least one of the plurality of connectors;

wherein the metal shrapnel is movable by the external device to be elastically pressed between the metal shell of the at least one of the plurality of connectors; and the external device.

2. The cable connector assembly as claimed in claim 1, wherein the shield shell comprises a top wall, a bottom wall, and a front wall together enclosing a front end of the insulative housing, both of the top wall and the bottom wall defining a perforation, the metal shrapnel having a first spring arm extending outwardly from an edge of the perforation and a second spring arm inwardly bent and extending from the first spring arm, and the first spring arm is capable of being pressed by the external device to drive the second spring arm to elastically connect with the metal shell of the connector.

3. The cable connector assembly as claimed in claim 2, wherein the insulative housing comprises an upper board, a lower board, a front board and a rear board, both of the upper board and the lower board defining a plurality of slots for exposing a part of the metal shell along an up-to-down direction, the second spring arm being movable to pass through the slot to elastically contact the metal shell.

4. The cable connector assembly as claimed in claim 2, wherein the metal shell comprises a top plate, a bottom plate, a left side wall, and a right side wall, each of the top plate and the bottom plate defines a tab protruding inward, and the second spring arm elastically contacts the tab.

5. The cable connector assembly as claimed in claim 3, wherein the connectors comprise a first connector and a second connector, and the insulative housing has a plurality of receiving cavities receiving the first connector and the second connector, the receiving cavities being separated from each other.

6. The cable connector assembly as claimed in claim 5, wherein the shield shell has a plurality of openings in the front wall, the opening is located opposite to the receiving cavity, and the connector is mounted in the opening.

7. The cable connector assembly as claimed in claim 5, wherein the first connector is a USB connector and the second connector is an audio jack.

8. The cable connector assembly as claimed in claim 7, wherein there are plural first connectors aligned in a transverse direction.

9. The cable connector assembly as claimed in claim 1, wherein the insulative housing has a plurality of tubers and the shield shell has a plurality of holes locking with the tubers.

10. The cable connector assembly as claimed in claim 1, wherein the insulative housing comprises a top shell and a bottom shell, the bottom shell having a plurality of embossments, the top shell having a plurality of locking plates retained to the embossments.

11. A cable connector assembly comprising:

an insulative housing defining a plurality of cavities therein, each of said cavities defining two corresponding front and upper openings open to an exterior forwardly and upwardly, respectively;

a plurality of shielded electrical connectors received in the corresponding cavities, respectively, each of said connectors including a mating port communicating with the exterior via the front opening, and a metallic outer shell enclosing an insulative housing unit therein, and a plurality of contacts disposed in the housing unit;

a plurality of cables electrically connected to the contacts of the corresponding connectors, respectively;

a metallic shield defining a contour compliantly enclosing the housing and forming a plurality of metallic deflectable spring arms each having an outer apex extending outwardly beyond an exterior surface of the contour, and an inner apex extending inward beyond an interior surface of the contour.

12. The cable connector assembly as claimed in claim 11, wherein the whole spring arm extends in a cantilevered manner.

13. The cable connector assembly as claimed in claim 12, wherein said cantilevered spring arm has a fixed root closer to the outer apex than to the inner apex.

14. The cable connector assembly as claimed in claim 11, wherein said outer apex is adapted to be electrically and mechanically connected to a metallic external device while the inner apex is adapted to be electrically and mechanically connected to the metallic shell of the corresponding connector.

15. The cable connector assembly as claimed in claim 14, wherein the inner apex of said spring arm is not mechanically and electrically connected to the shell of the corresponding connector before the outer apex is electrically and mechanically connected to the external device.

16. The cable connector assembly as claimed in claim 11, wherein said spring arm is connected to the shell of the corresponding connector when said spring arm is in a compressed manner while being not when in a relaxed manner.

17. The cable connector assembly as claimed in claim 16, wherein the shell of the connector includes a spring tang for retaining a plug which is adapted to be received in the mating port, and the inner apex is aligned with and adapted to be mechanically and electrically connected to said spring tang when said spring arm is in a compressed manner.

18. A cable connector assembly comprising:

an insulative housing defining a plurality of receiving cavities;

a plurality of electrical connectors received within the corresponding receiving cavities, respectively, each of said connectors including an outer metallic shell; and a metallic shield compliantly enclosing the housing and forming a plurality of metallic deflectable spring levers each including an outer spring arm and an inner spring arm correlated with each other in a co-movement manner; wherein the inner spring arm is adapted to be mechanically and electrically connected to the metallic shell of the corresponding connector, and the outer spring arm is adapted to be connected to a metallic external device beside the shield.

19. The cable connector assembly as claimed in claim 18, wherein said inner spring arm is mechanically and electrically connected to the shell of the corresponding connector when the outer spring arm is mechanically and electrically connected to the external device while is not when the outer spring arm is not.

20. The cable connector assembly as claimed in claim 19, wherein said spring lever is essentially cantilevered and a root of said spring lever is formed on the outer spring arm.

* * * * *